United States Patent [19]

House et al.

[11] Patent Number: 4,752,014

[45] Date of Patent: Jun. 21, 1988

[54] TAMPER-EVIDENT CHILD-RESISTANT CLOSURE AND CONTAINER WITH SAME

[75] Inventors: Randall F. House, Bridgewater, N.J.; Steven B. Juk, Jarrettsville, Md.

[73] Assignee: Poly-Seal Corporation, Baltimore, Md.

[21] Appl. No.: 133,652

[22] Filed: Dec. 16, 1987

[51] Int. Cl.[4] ..... B65D 55/02

[52] U.S. Cl. ..... 215/216

[58] Field of Search ..... 215/216, 218, 330

[56] References Cited

U.S. PATENT DOCUMENTS 4,413,742 11/1983 Sandhaus ..... 215/216

4,687,112 8/1987 Swartzbaugh ..... 215/216

*Primary Examiner*—George T. Hall

*Attorney, Agent, or Firm*—Leonard Bloom

[57] ABSTRACT

A container and safety closure therefor includes a hollow container having an externally threaded tubular neck defining a tubular opening into the container. An outer surface area of the container extending outwardly from and adjacent to the neck or portion of the neck or stepped portion thereof or an attached ring has a plurality of recesses extending inwardly. An internal threaded closure adapted to screw on to and off the threaded neck is provided with a web formed integral with a lower edge of the closure and extends outwardly from one side thereof adjacent to the neck. A tab extends upwardly from the web. A pawl formed integrally with either an under surface of the web or in an inwardly facing vertical surface on the web or an outwardly facing surface of the tab is provided to engage the recesses in the container or neck thereof or in the ring when the closure is threadably moved downwardly on the neck. The upstanding tab extends upwardly from distal end of the web. At least one tamper-evident indicating, frangible web connects the upstanding tab to the closure, this web or webs being fracturable by application of a radially, inwardly directed force to the tab which breaks the frangible web or webs and allows disengagement of the pawl from the recesses so that the closure may be removed from the container.

45 Claims, 4 Drawing Sheets

TAMPER-EVIDENT CHILD-RESISTANT CLOSURE AND CONTAINER WITH SAME

BACKGROUND OF THE INVENTION

1. Field of the Invention

This invention relates generally to child-resistant closures for containers and to containers provided with such closures. More particularly, the invention relates to child-resistant closures provided with a tamper-evident indicating feature and to containers provided with such closures.

2. The Prior Art

It is known from U.S. Pat. No. 3,895,730 granted July 22, 1975 to Anthony J. Koehne et al. and entitled "Safety Container" to provide a container which has an externally threaded tubular neck having an opening extending through the neck to the container wherein the neck extends outwardly from the container body to threadably receive a closure. The area of the top of the tubular neck is either perpendicular or tapered downwardly from the tubular neck in which at least the area adjacent to the neck is provided with means cooperating with a locking means carried by the closure to prevent the normal rotation of the closure in the opposite direction to the downward pitch of the thread carried by the neck. The locking means is manually operable to disengage the locking means carried by the closure to allow the closure to be rotated to remove the closure from the container neck. This particular container and closure are not provided with any tamper-evident feature, a distinct shortcoming.

The U.S. Pat. No. 3,924,769 issued Dec. 9, 1975 to William E. Fillmore and entitled "Single Use Safety Closure" discloses a single-use safety closure. The closure is molded as a unitary body which includes a main body portion, a flexible skirt portion and a locking ring. The skirt is connected to the main body by a flexible circumferential ring. The locking ring is connected to the skirt by a plurality of frangible ribs. In application the closure is threaded into the finish of a jar, bottle or the like. Once tightened the closure cannot be removed readily from the finish, because of the projections locking together and cooperating to form a one-way ratchet drive. When the main body portion is moved in an opening direction, a force is placed on the projections, the skirt bows outwardly allowing one to unseal the container. The closure is not readily adapted for multiple-use type containers which may be reopened and closed a number of times, a shortcoming.

U.S. Pat. No. 4,345,610 granted Aug. 24, 1982 to Eric T. Hopley and entitled "Safety Container" relates to a container and a closure cap therefor, wherein the neck of the container is screw-threaded and is provided with at least one lug beneath the screw thread, the closure cap comprising a top, a screw-threaded depending skirt and an annular band attached to the skirt by spaced bridges. The annular band is provided with fins adapted to engage the lugs on the container neck. The annular band is deformable by radial pressure at positions spaced from the fins to increase the diameter of the band in the region of the fins such that the fins do not engage the lugs on the container neck. Any attempt to unscrew the cap from the container brings the fins into contact with stop surfaces of the lugs. Inwardly directed, radial pressure applied to the band is necessary to move the fins clear of the stop surfaces. No provision is made to provide a tamper-indicating feature.

A child- and tamper-resistant closure for a container is known from U.S. Pat. No. 4,471,878 issued Sept. 18, 1984 to Eugene F. Davis et al. and entitled "Child and Tamper Resistant Closure". The closure has a top, a depending inner skirt, a depending outer skirt (which is longer than the inner skirt) and a tamper-resistant band. The tamper-resistant band is connected to the bottom of the skirt by frangible tongues. Spaced apart, individual lugs arranged opposite to one another, are provided on the outer skirt. The bottom of the outer skirt and the band have respective pluralities of teeth which cooperate. To open the container, one must first squeeze pads to distort the outer skirt moving the lugs beyond cam shoulders, stretching and breaking the band.

Another known tamper-indicating, resistant closure is disclosed in U.S. Pat. No. 4,572,385 granted on Feb. 25, 1986 to Edward Luker and entitled "Tamper Indicating Child Resistant Threaded Closure". The closure is provided by a one piece threaded cap having a nonbackoff feature. The child resistant component is provided by a squeeze and twist lock having a deflectable tab which cooperates with a radially extending container abutment spaced from the container neck. A radially extending tamper indicating block attached to the cap skirt by a frangible web also aligns with the container abutment and prevents opening unthreading until the block is removed. The nonbackoff feature is provided by an inwardly directed flange at the bottom of the cap skirt cooperating with a container bead. A similar closure is disclosed in U.S. Pat. No. 4,540,098 granted Sept. 10, 1985 to Edward Luker and entitled "Tamper Indicating Child Resistant Closure". In this case a frangible, removable tamper indicating element is provided to maintain a lock tab in circumferentially spaced relationship to a lock member; squeeze points in alignment with ramp means on the container prevent radial inward deflection and opening rotation of the closure until the tamper indicating element is broken away and removed.

A safety container which includes an externally threaded tubular neck having an opening extending through the neck to the container is known from the U.S. Pat. No. 3,895,730 issued July 22, 1975 to Anthony J. Koehne et al. and entitled "Safety Container". The neck extends outwardly from the container body to threadably receive a closure, the area of the top of the tubular neck being either perpendicular or tapered downwardly from the tubular neck in which at least the area adjacent the neck is provided with means cooperating with a locking means carried by the closure to prevent the normal rotation of the closure in the opposite direction to the downward pitch of the thread carried by the neck, the locking means being manually operable to disengage the locking means carried by the closure to allow the closure to be rotated to remove the closure from the container neck.

Other tamper-indicating, child-resistant closures are also known. Among these is a screw-type closure which is disclosed in U.S. Pat. No. 4,630,743 granted Dec. 23, 1986 to David M. Wright and entitled "Tamper Indicating Child Resistant Closure". The container is equipped with lock members along the threaded neck and a loading ramp carried on the threaded portion of the neck. The closure has concentric inner and outer skirts depending from the top and a lock tab depending from the outer skirt. A T-shaped tamper indicating means is frangibly attached to the outer skirt and to the inner skirt by means of shear webs. The tamper indicating means has a riding ramp along the inner periphery of the inner skirt to engage the loading ramp during application of the closure to the container to avoid premature removal of the tamper indicating means.

As can be seen from the foregoing text, tamper-indicating features have been provided on some closures for containers and others have been provided with child-resistant features. In a few cases both tamper-indicating and child-resistant features may be provided in the same closure-container combination as separate and distinct features. The constructional elements of such closure-containers do not serve both functions.

SUMMARY OF THE INVENTION

An object of the present invention is to provide a tamper-evident, child-resistant closure and a container provided with same in which constructional elements forming part of tamper-evident indicating means also function as part of child-resistant elements.

Another object of the present invention is to provide a tamper-evident, child-resistant closure and a container provided with same of the above-noted character which is simple and yet highly reliable in both its tamper-evident and child-resistant functions.

An additional object of the present invention is to provide a tamper-evident, child-resistant closure and a container provided with same which achieves the above-noted objects and is inexpensive to manufacture.

From one vantage point, the invention can be seen as a container and safety closure therefor. The container has an external thread on a portion thereof and an opening extending into the container. An area of the container has a plurality of recesses extending inwardly from the outer surface of the container. A closure provided with an internal thread is adapted to screw on to and off the external thread on the mentioned threaded portion of the container. The closure has a first web which extends from one side thereof. A pawl extends from a surface of the first web to engage the recesses in the container when the closure is threadably moved downwardly. An upstanding tab extends upwardly from said first web. At least one tamper-evident indicating, frangible web connects the upstanding tab to the closure, the tamper-evident web or webs being fracturable by application of radially, inwardly directed force to the tab to fracture the frangible web or webs without fracturing the first web and disengage the pawl from the recesses so that the closure may be removed from the container.

In a similar, subcombination aspect, the invention can be viewed as a safety closure comprising an internally threaded cap provided with an internal thread, the cap having a first web extending therefrom for engagement with recesses on a surface of a container. A pawl extends from a surface of the first web and an upstanding tab extends upwardly from the first web. At least one tamper-evident indicating, frangible web connects the upstanding tab to the cap, the tamper-evident web or webs being fracturable by application of radially, inwardly directed force to the tab to fracture the frangible web or webs without fracturing the first web. Thus, the pawl may be removed from recesses in a surface of a container and the closure removed from and replaced on same.

The invention in another aspect, is in a container and safety closure therefor. The container is a hollow container having an externally threaded portion, its tubular opening extending into the hollow container. An area of the container extends the from the threaded portion and includes an outer surface of the container provided with a plurality of recesses inwardly from the outer upper surface of the container. A closure is provided with an internal thread to screw on to and off the externally threaded portion, the closure having a first web extending from a lower portion of the closure outwardly from one side thereof to a point overlying the recesses and out of engagement therewith. A pawl extending from an under surface of the first web engages the recesses in the container when the closure is threadably moved downwardly. An upstanding tab extends upwardly from distal end of the first web. At least one tamper-evident indicating, frangible web connects the upstanding tab to said closure, the tamper-evident web or webs being fracturable by application of radially, inwardly directed force to the tab to fracture the frangible web or webs without fracturing the first web and disengage the pawl from the recesses so that the closure may be removed from the container.

From one species viewpoint, the invention can be seen as a container and safety closure therefor, which includes in combination, a container having an externally threaded portion and having an opening extending into the container, an area of the container spaced from the threaded portion including a step defining a substantially vertical surface spaced from the threaded portion and having a plurality of recesses inwardly from the substantially vertical surface. A closure provided with an internal thread is adapted to screw on to and off the externally threaded portion of the container. The closure has a first web extending therefrom adjacent to the threaded portion and an upstanding tab extending upwardly from the first web. A pawl extends radially outward from the tab to engage the recesses in the substantially vertical surface when the closure is threadably moved downwardly.

At least one tamper-evident indicating, frangible web connects the upstanding tab to the closure, the at least one tamper-evident web being fracturable by application of radially, inwardly directed force to the tab to fracture the at least one frangible web without fracturing the first web. The pawl thus can be disengaged from the recesses so that the closure may be removed from the container.

In a subcombination aspect the invention is a safety closure having an internally threaded cap provided with an internal thread adapted to screw on to and off an externally threaded neck of a container. The cap has a first web extending outwardly from one side thereof for engagement with recesses on a surface of a container. A pawl extending from a surface of the first web engages recesses in a container when the closure is threadably moved downwardly on a neck thereof. An upstanding tab extends upwardly from distal end of the first web. At least one tamper-evident indicating, frangible web connects the upstanding tab to the cap, the web or webs being fracturable by application of radially, inwardly directed force to the tab to fracture the frangible web or webs without fracturing the first web and move the pawl from the recesses so that the closure may be removed from a container.

From another subcombination viewpoint, the invention is an internally threaded cap provided with an internal thread, the cap having a first web extending outwardly thereof. An upstanding tab extends upwardly from the first web, a pawl extending radially outward from a surface of the upstanding tab. At least one tamper-evident indicating, frangible web connects the upstanding tab to the cap, the at least one tamper-evident web being fracturable by application of radially, inwardly directed force to the tab to fracture the at least one frangible web, without fracturing the first web. The pawl thus may be removed from recesses in a surface of a container and the closure removed from and replaced on same.

The first web is desirably integral with a lower edge portion of the closure and the pawl is preferably integral with the web.

The safety closure preferably has a top and includes a cylindrical portion which carries the internal thread. An outer skirt is provided, the first web extending to the outer skirt and the outer skirt depending from the top of the closure. The tab is separated from the outer skirt by a pair of longitudinal slots.

The top of the closure in one variant is provided with a void positioned inwardly and between the pair of slots.

In a second variant, the tab is connected to the top of the closure, a line of weakening being provided between the tab and the top of the closure.

In a third variant, the tab is separated from the top of the closure by a further slot.

The at least one tamper-evident indicating frangible web comprises, in preferred embodiments, a pair of frangible webs connecting opposite sides of the upstanding tab to the closure in vicinity of respective upper ends of the slots.

The closure desirably includes an outer skirt, a pair of tamper-evident indicating frangible webs connecting opposite sides of the upstanding tab to the outer skirt in vicinity of respective upper ends of the slots.

While several objects of the present invention in a container and safety closure therefor have been noted above, other objects, uses and advantages are to become apparent as the nature and features of the invention are described in more detail herein below, references being made to accompanying drawings.

DETAILED DESCRIPTION OF THE PREFERRED EMBODIMENTS

In reference to the drawings, like and similar references numerals are used to identify like and similar parts throughout the several embodiments and views.

Figure 1:
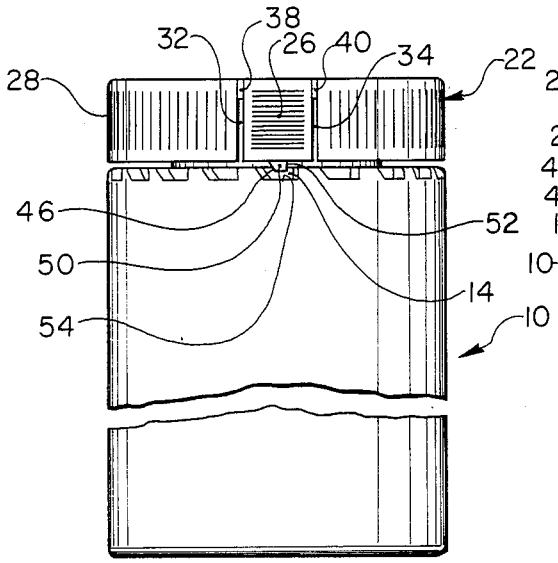
FIG. 1 is a view in elevation of a container and a closure therefor, in accordance with a first exemplary embodiment of the present invention.
Figure 2:
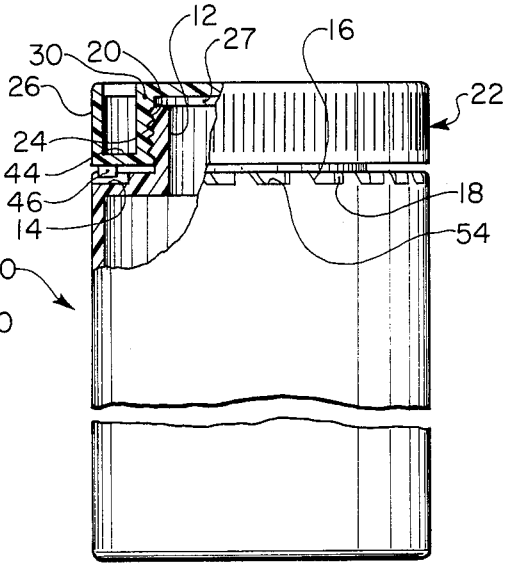
FIG. 2 is a view in elevation of the container and closure shown in FIG. 1, rotated at a 90 degree angle with respect to the view shown in FIG. 1, a portion having been broken away to show details of the exemplified construction.
Figure 4:
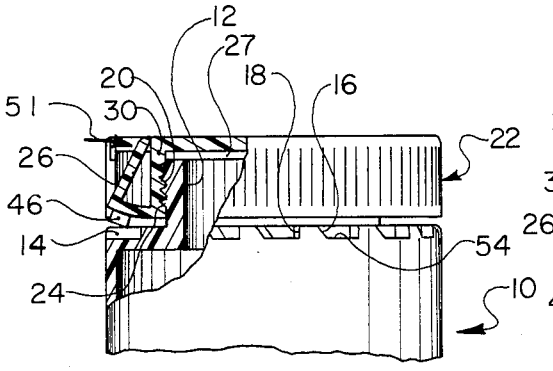
FIG. 4 is a fragmentary view in elevation of the specific portion of the container and closure illustrated in FIGS. 1–3 showing the closure having its locking means disengaged.

The container 10, as illustrated in FIGS. 1, 2 and 4, is shown as being of cylindrical shape, but may be of any desirable convenient shape. The container 10 is formed with an externally threaded cylindrical neck 12 (FIGS. 2, 4). The area adjacent to the upper surface of the container 10, as illustrated surrounding the neck 12, is in a plane substantially perpendicular to the axis of the neck, but may be any convenient angle with respect to this axis without departing from the present invention. This area adjacent to the tubular neck 12, which may be at any desired angle as noted above, is provided with a plurality of circumferentially-spaced recesses 14 to form a type of ratchet, each of the recesses having a sloping side 16 and a straight vertical side 18, as best seen in FIG. 2, substantially parallel to the side of the tubular neck.

Threadably receivable on external thread 20 (FIGS. 2, 4) of the neck 12, is a cap or closure 22. The closure 22 is provided with an internal thread 24 (FIGS. 2, 4) on a convention cylindrical portion 30 adapted to engage the cooperating external thread 20 on the tubular neck 12. There is normally provided a sealing element 27 positioned between the inner upper surface of the closure 22 and the outer end of the neck 12, as best shown in FIGS. 2 and 4. The closure 22, in accordance with exemplary embodiments of the present invention is provided with an outer skirt 28 having a knurled outer surface, the outer skirt being radially positioned outwardly from the downwardly cylindrical portion 30, which may be considered an inner skirt, of the closure 22 which carries the internal thread 24.

Figure 3:
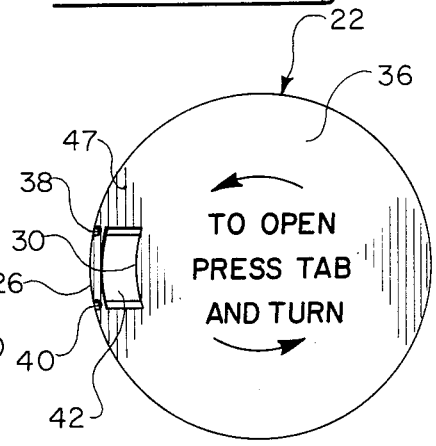
FIG. 3 is a top plan view of the closure shown in FIG. 1.
Figure 5:
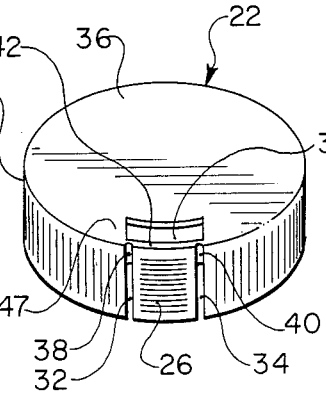
FIG. 5 is a perspective, pictorial view of the closure shown in FIGS. 1–4.

The outer skirt 28, as shown in FIG. 5, is provided with a pair of slits or slots 32 and 34 extending longitudinally, the slots stopping short of the top surface 36 of the closure 22; as illustrated, the point at which the upward ends of the slots 32 and 34 stop corresponds to the thickness of the top of the closure 22 and define a pair of frangible tamper-evident indicating webs 38 and 40. A portion 47 of the top surface 36 of the closure 22 extends circumferentially and radially outward from the cylindrical portion 30 (FIGS. 2, 4) to the outer skirt 28, a substantially rectangular void 42, as best seen in FIGS. 3 and 5, being defined in the top of the closure 22 between the pair of slots 32 and 34. As seen in FIGS. 3 and 5, the tamper-evident webs 38 and 40 are defined by a pair of lines of weakening. As best seen in FIG. 3, the lines of weakening 38 and 40 are defined by respective indentations or grooves which are arcuate in cross section and extend from the top of the slots 32 and 34 (FIG. 5) to the top surface of the circumferential portion 47 of top 36. It is to be understood that the indentations or grooves could be of different shapes as well; for example, the grooves could be of triangular shape and could in any case, be of nonuniform depth along their lengths.

Between the pair of slots 32 and 34, a radial deflectable upstanding tab 26 is provided. The tab 26 may be formed integrally as part of the closure 22 and is connected to the cylindrical portion 30 of the closure 22 by a radially extending web 44 (FIGS. 2, 4), which extends from the lower end of the tab 26 to the lower end of the cylindrical portion 30 of the closure 22. Formed integrally with or affixed to the under surface of the web 44 adjacent to its outer end, is a pawl 46 (FIGS. 1, 2 4), adapted to engage ratchet teeth defined by the recesses 14 formed on the finish of the container 10 in an upper surface 48 thereof. The outer skirt 28 of the closure 22 is radially spaced from the cylindrical portion 30 thereof and normally extends substantially parallel to the surface surrounding the neck 12 of the container 10 and the cylindrical portion, as shown in FIGS. 1, 2 and 4. The closure 22, when tightly screwed downwardly on the neck 12 of the container 10, effectively closes the neck opening thereof.

As the closure 22 is screwed downwardly onto the neck 12, the pawl 46 will begin to engage the recesses 14, and act as a ratchet holding means to prevent the closure 22 from being rotated in the reverse direction. The pawl 46 will move from one of the recesses 14 to the next as the closure 22 is tightened downwardly upon the container neck 12, the vertical portion of the tab 26 becoming bowed without the breaking of the frangible webs 38 and 40, defined by the grooves, and which connect the upper end of the tab to the skirt 28 in the vicinity of the upper surface of the peripheral portion 47 of the top 36 closure 22. It is to be noted that the pawl 46 is provided with a bevelled side 50, as best seen in FIG. 1, which slides over the sloping sides 16 of the recesses 14, whenever the closure 22 is being applied to the neck 12. When the motion of the closure 22 is reversed on the neck 12 of the container 10, a vertical straight side 52, as best seen in FIG. 1, of the pawl 46 will engage the straight side 18 of one of the recesses 14 and prevent the rotation of the closure 22 and its removal from the container neck, so long as the frangible webs 38 and 40 of the closure 22 have not been broken. Thus, one can determine by visual inspection if the closure 22 has been removed by observing the condition of the frangible webs 38 and 40 and the top portion of the tab 26.

To remove the closure 22, from the container 10, the outer, lower end of the tab 26 is raised by application of a radially inwardly directed force to the tab, as diagramatically indicated by an arrowheaded line 51 in FIG. 4, to a point where the webs 38 and 40 become fractured and the pawl 46 becomes disengaged from that one of the recesses 14 in which it rested, allowing the closure 22 to be rotated in the opposite direction to remove the closure from the container neck 12.

It will be noted that the pawl 46 preferably does not extend to the bottom 54 of the recesses 14 when the closure 22 is completely screwed on to the neck 12 of the container 10, as shown in FIGS. 1 and 2. Having the pawl 46 positioned so that its lowermost surface is spaced upwardly from the bottom of the recesses 14, even when the closure 22 is in its completely closing position on the container 10, prevents any false impression that the closure is squarely and tightly fitted upon the neck 12 of the container. The clearance provided by the space between the bottom 54 of the recesses 14 and the lower end of the pawl 46 must be sufficient to allow the pawl to be removed from the recess as the tab 26 is moved radially inward. It is to be appreciated, were the recesses 14 formed in an outwardly radial, downwardly inclined upper surface on the finish of a container, less clearance would be required.

As shown in FIGS. 1–5, the cap or closure 22 is provided with the substantially rectangular void 42 in its top surface, the void extending from the circumference of the outer skirt 28 to the cylindrical portion 30 of the closure 22 which is provided with the internal thread 24. Such a construction, allows the closure 22 to be readily molded as a single unitary element. Other embodiments and variants are possible.

Figure 6:
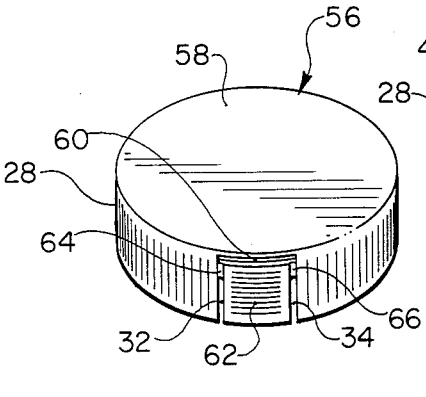
FIG. 6 is a perspective view of an exemplary variant of the closure illustrated in FIG. 5 constructed in accordance with the present invention.

Among these, as illustrated in FIG. 6, is a somewhat differently constructed cap or closure 56 which does not include a void corresponding to the void 42 (FIGS. 1–5); instead, the top surface 58 extends radially outwardly to the circumference thereof intersecting with the outer skirt 28, providing a somewhat different esthetic appearance. A slit or slot 60 is provided along the intersection between the top 58 of the closure 56 and an upstanding tab 62 which serves the same functions as the tab 26 (FIGS. 1–5), this slot being perpendicular to, but not intersecting with the vertical slits or slots 32 and 34. In place of the frangible webs 38 and 40 (FIGS. 1–5), the closure 56 is proved with a pair of frangible webs 64 and 66 extending from the ends of the slot 60 and respective upper ends of the slots 32 and 34, which separate the tab 62 from the outer skirt 28. In this case the top 58 may be molded as a separate constructional element and thereafter fixed to the cylindrical portion and outer skirt 28 of the closure 56 by a suitable epoxy or the like. The tab 62 is fixed to the inner skirt (not visible) by a web (not visible) which corresponds to the web 44 (FIGS. 2, 4).

Figure 7:
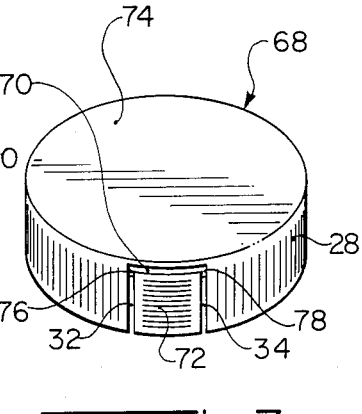
FIG. 7 is a perspective view of a further variant of the closure of FIG. 5 constructed in accordance with the present invention.

In a somewhat differently constructed cap or closure designated generally by the numeral 68 in FIG. 7, the slot 60 (FIG. 6) is replaced by a line of weakening, indicated by the numeral 70; this allows one to apply radially inwardly directed force to a tab 72 which will effect a separation of the tab from the top 74 of the closure 68 and from the outer skirt 28 and, at the same time, allow the fracturing of the tamper-evident frangible webs 76 and 78, which are defined by respective lines of weakening between the outer skirt 28 and the tab 72. Like the embodiment of the closure 56 (FIG. 6), the closure 68 may be molded as two separated parts which are thereafter fixed to one another using conventional techniques. It is to be understood that the closure of FIG. 7 may be modified, by forming the vertical slots 32 and 34 somewhat longer so that these slots intersect the groove or indentation defining the line of weakening 70, thus eliminating the vertical lines of weakening 76 and 78.

Both the container and the caps or closures are of such construction that each may be molded from plastics material on a high production basis using conventional molding techniques. Other materials and forming techniques could be used as well. The containers may be formed of glass or the like. It is, of course, necessary that the tab 26 (FIGS. 1–5), the tab 62 (FIG. 6) and the tab 72 (FIG. 7) be able to be bowed as the closures are being placed on the container, without fracturing the tamper-evident indicating webs. The lines of weakening which define the frangible web or webs could, if desired, be made on the inside surface of the outer skirt instead of the outside surfaces, as illustrated, and may, in any case, be defined by grooves or indentations of unequal depth along their lengths.

Figures 8, 9, 10:
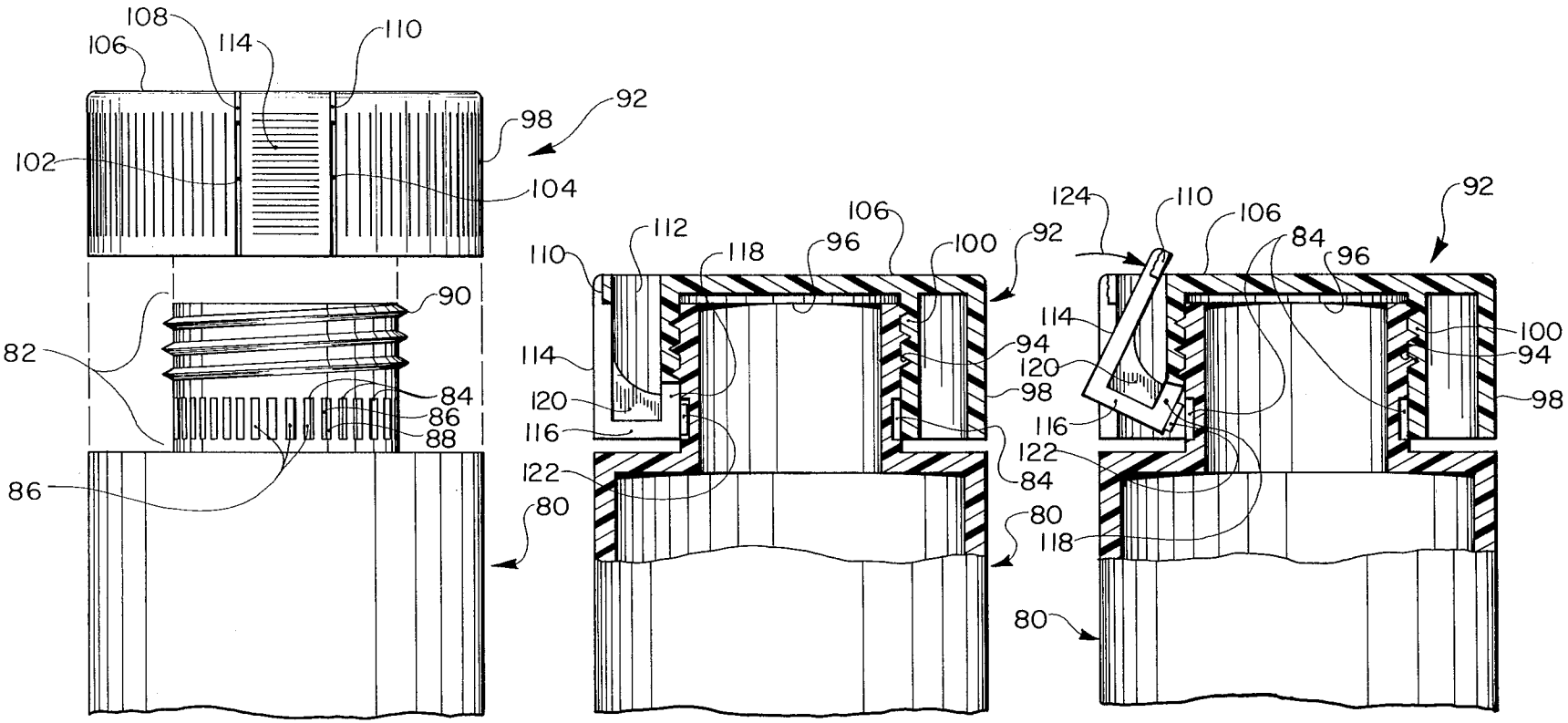
FIG. 8 is an exploded view in elevation of a container, shown fragmentarily, and a closure therefor, in accordance with a second exemplary embodiment of the present invention.
FIG. 9 is a view in elevation of the container and closure shown in FIG. 8, fully closed and rotated at a 90 degree angle with respect to the view shown in FIG. 8, a portion having been broken away to show details of the exemplified construction.
FIG. 10 is a view in elevation of the container and closure illustrated in FIGS. 8 and 9, the closure being shown in a configuration wherein it may be removed from the container.

As shown in FIGS. 8–10, a second exemplary embodiment of the present invention includes a container 80, shown as being of cylindrical shape. The container 80 may be of any desirable convenient shape. The container 80 is formed with an externally threaded cylindrical neck 82, best visible in FIG. 8. An area adjacent to the upper surface of the container 80 on the lower portion of the neck 82 is provided with a plurality of circumferentially-spaced recesses 84 to form a type of ratchet, each of the recesses having a sloping side 86 (FIG. 8) and a straight vertical side 88 (FIG. 8) substantially parallel to the axis of the tubular neck 82, providing an easy-on hard-off ratchet configuration.

Threadably receivable on external thread 90, best shown in FIG. 8, on the upper portion of the neck 82, is a cap or closure 92. The closure 92 is provided with an internal thread 94 (FIGS. 9, 10) on a convention cylindrical portion thereof adapted to engage the cooperating external thread 90 on the tubular neck 82. There is normally provided a sealing element 96 positioned between the inner upper surface of the closure 92 and the outer end of the neck 82, as illustrated in FIGS. 9 and 10. The closure 92, in accordance with the present invention is provided with an outer skirt 98 having a knurled outer surface, the outer skirt being radially positioned outwardly from the downwardly extending cylindrical portion 100, which may be considered an inner skirt, of the closure 92 which carries the internal thread 94.

The outer skirt 98, as shown in FIG. 8, is provided with a pair of slits or slots 102 and 104 extending longitudinally, the slots stopping short of top surface 106 of the closure 92; as illustrated, the point at which the upward ends of the slots 102 and 104 stop corresponds to the thickness of the top of the closure 92 and define a pair of frangible tamper-evident indicating webs 108 and 110. A portion of the top surface 106 of the closure 92 which extends circumferentially and radially outward from the cylindrical portion 100 (FIGS. 9, 10) to the outer skirt 98, a substantially rectangular void 112, as seen in FIG. 9, being defined in the outside of the closure 82 between the pair of slots 102 and 104, the top of the closure 92 having the same appearances of the top of the closure 22 as shown in FIG. 3 and the void 112 being shaped as the void 42. As seen in FIG. 8, the tamper-evident webs 108 and 110 are defined by a pair of lines of weakening. The lines of weakening 108 and 110 are defined by respective indentations or grooves which may arcuate in cross-section and extend from the top of the slots 102 and 104 (FIG. 8) to the top surface of the circumferential portion of closure 92. It is to be understood that the indentations or grooves could be of different shapes as well; for example, the grooves could be of triangular shape and could in any case, be of nonuniform depth along their lengths.

Between the pair of slots 102 and 104, a radial deflectable upstanding tab 114 is provided. The tab 114 may be formed integrally as part of the closure 92 and is connected to the cylindrical portion 100 of the closure 92 by a radially extending web 116 (FIGS. 9, 11), which extends from the lower end of the tab 114 to the lower end of the cylindrical portion 100 of the closure 92. A pair of spaced-apart slots extend upwardly into the lower part f the cylindrical portion 100 to points below the internal thread 94, a side surface 118 of one of these slots 118 being visible in FIGS. 9 and 10. At least one strengthening web 120 is provided between the tab 114 and the cylindrical portion 100. The strengthening web 120 is positioned radially outward and between the pair of slots in the cylindrical portion 100.

Formed integrally with or affixed to a radially inwardly facing surface of the web 116 is a pawl 122 (FIGS. 9, 10), adapted to engage ratchet teeth defined by the recesses 84 formed on the lower portion of the neck 82. The outer skirt 98 of the closure 92 is radially spaced from the cylindrical portion thereof and normally extends substantially parallel to the surface surrounding the neck 82 of the container 80 and the cylindrical portion. The closure 92, when tightly screwed downwardly on the neck 82 of the container 80, effectively closes the neck opening thereof.

As the closure 92 is screwed downwardly onto the neck 82, the pawl 122 will begin to engage the recesses 84, and act as a ratchet holding means to prevent the closure 92 from being rotated in the reverse direction. The pawl 122 will move from one of the recesses 84 to the next as the closure 92 is tightened near the end of its downward travel on the neck 82, the vertical portion of the tab 114 becoming bowed without the breaking of the frangible webs 108 and 110, defined by the grooves, and which connect the upper end of the tab 114 to the outer skirt 98 in the vicinity of the upper surface of the peripheral portion of the top surface 106 closure 92. It is to be noted that the pawl 122 is provided with a bevelled side (like the bevelled side 50, FIG. 1), which slides over the sloping sides 86 of the recesses 84, whenever the closure 92 is being tightened on the neck 82. When the motion of the closure 92 is reversed on the neck 82 of the container 80, a vertical straight side of the pawl 122 (like the straight side 52, FIG. 1) will engage the straight side 88 of one of the recesses 84 and prevent the rotation of the closure 92 and its removal from the container neck 82, so long as the frangible webs 108 and 110 of the closure have not been broken. Thus, one can determine by visual inspection if the closure 92 has been removed by observing the condition of the frangible webs 108 and 110 and the top portion of the tab 114.

To remove the closure 92, from the container 80, the outer, lower end of the tab 114 is raised by application of a radially inwardly directed force to the tab, as diagramatically indicated by an arrowheaded line 124 in FIG. 10, to a point where the webs 108 and 110 become fractured and the pawl 122 becomes disengaged from that one of the recesses 84 on the container neck 82 in which it rested, allowing the closure 92 to be rotated in the opposite direction to remove the closure from the container neck.

The closure 92 shown in FIGS. 8–10 has the appearance of the first-described closure 22 illustrated in FIGS. 5 and 6, when oriented as shown therein and viewed from the outside. It is to be understood that the closure 92 of FIGS. 8–10 can be modified so that it would appear, again as viewed from the outside, like the closures 56 and 58, as illustrated respectively in FIGS. 6 and 7. In these cases, the pawl 122 and web 116 would be constructed as shown in FIGS. 9 and 10.

Figure 13:
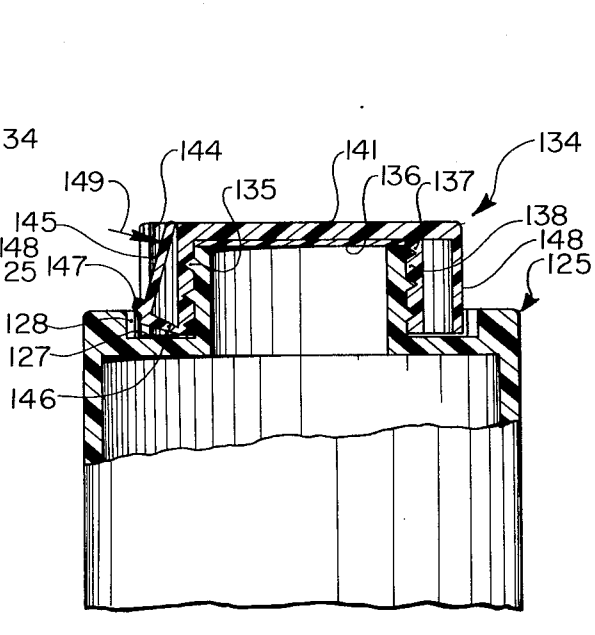
FIG. 13 is a view in elevation of the container and closure illustrated in FIGS. 11 and 12, the closure being shown in a configuration wherein it may be removed from the container.
Figure 12:
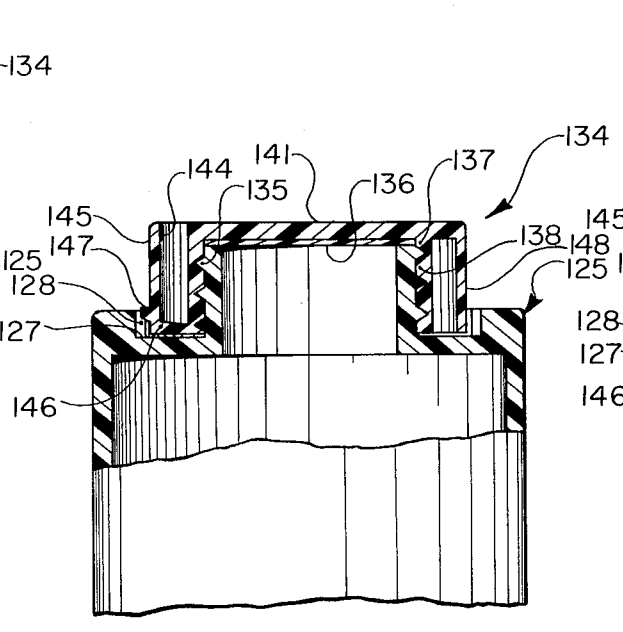
FIG. 12 is a view in elevation of the container and closure shown in FIG. 11, fully closed and rotated at a 90 degree angle with respect to the view shown in FIG. 11, a portion having been broken away to show details of the exemplified construction.
Figure 11:
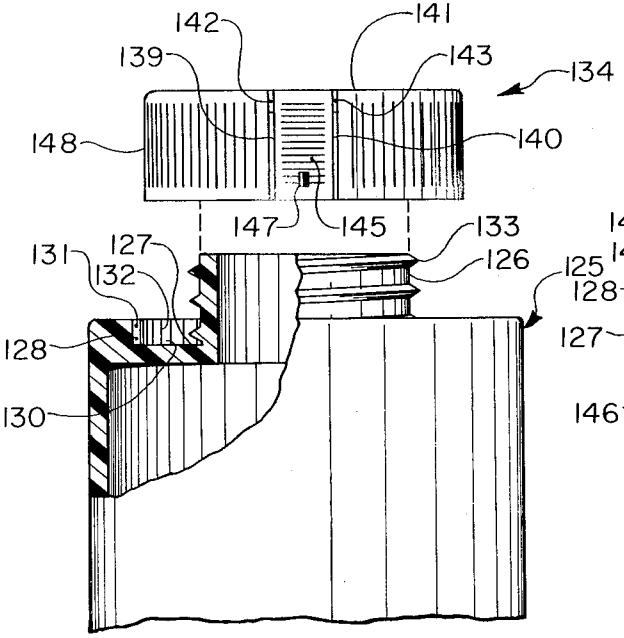
FIG. 11 is an exploded view in elevation of a container, shown fragmentarily, and a closure therefor, in accordance with a third exemplary embodiment of the present invention, a portion of the container being shown in cross-section to show details and placement of recesses defining ratchet teeth.

As shown in FIGS. 11–13, a third exemplary embodiment of the present invention includes a container 125, shown as being of cylindrical shape. The container 125 may be of any desirable convenient shape. The container 125 is formed with an externally threaded cylindrical neck 126, best visible in FIG. 11. A step 127 is provided in an area adjacent to the neck 126, the step 127 defining a circumferential vertical surface 128 spaced from the neck and substantially parallel thereto. A plurality of circumferentially-spaced recesses 130, visible in FIG. 11, are provided in the surface 128 to form a ratchet, each of the recesses having a sloping side 131 (FIG. 11) and a straight side 132 (FIG. 11) substantially parallel to the axis of the tubular neck 126, providing an easy-on, hard-off ratchet configuration.

Threadably receivable on an external thread 133, best shown in FIG. 11, on the upper portion of the neck 126, is a cap or closure 134. The closure 134 is provided with an internal thread 135 on a convention cylindrical portion thereof adapted to engage the cooperating external thread 133 on the tubular neck 126. There is normally provided a sealing element 136 (FIGS. 12, 13) positioned between the inner upper surface of the closure 134 and the outer end of the neck 126, as illustrated in FIGS. 11 and 12. The closure 134, in accordance with the present invention is provided with an outer skirt 148 having a knurled outer surface, the outer skirt being radially positioned outwardly from the downwardly extending threaded cylindrical portion 137 (FIGS. 12, 13), which may be considered an inner skirt, of the closure 134 which carries the internal thread 138 (FIGS. 12, 13).

The outer skirt 148, as shown in FIG. 11, is provided with a pair of slits or slots 139 and 140 extending longitudinally, the slots stopping short of top surface 141 of the closure 134; as illustrated, the point at which the upward ends of the slots 139 and 140 stop corresponds to the thickness of the top of the closure 134 and define a pair of frangible tamper-evident indicating webs 142 and 143. A portion of the top surface 141 of the closure 134 which extends circumferentially and radially outward from the cylindrical portion 137 (FIGS. 11, 12) to the outer skirt 148, a substantially rectangular void 144 (FIGS. 12, 13), being defined in the outside of the closure 134 between the pair of slots 139 and 140, the top of the closure 134 having the same appearances of the top of the closure 22 as shown in FIG. 3 and the void 144 being shaped as the void 42 (FIG. 5). As seen in FIG. 11, the tamper-evident webs 142 and 143 are defined by a pair of lines of weakening. The lines of weakening are defined by respective indentations or grooves which may arcuate in cross-section and extend from the top of the slots 139 and 140 (FIG. 11) to the top surface of the circumferential portion of closure 134. It is to be understood that the indentations or grooves could be of different shapes as well; for example, the grooves could be of triangular shape and could in any case, be of nonuniform depth along their lengths.

Between the pair of slots 139 and 140, a radial deflectable upstanding tab 145, best seen in FIG. 11, is provided. The tab 145 may be formed integrally as part of the closure 134 and is connected to the cylindrical portion 137 of the closure 134 by a radially extending web 146 (FIGS. 12, 13), which extends from the lower end of the tab 145 to the lower end of the cylindrical portion 137 of the closure 134.

Formed integrally with or affixed to a radially outwardly facing surface of the tab 145 is a pawl 147 (FIGS. 12, 13), adapted to engage ratchet teeth defined by the recesses 130 formed on the vertical surface 128. The outer skirt 148 of the closure 134 is radially spaced from the cylindrical portion thereof and normally extends substantially parallel to the surface surrounding the neck 126 of the container 125 and the cylindrical portion. The closure 134, when tightly screwed downwardly on the neck 126 of the container 125, effectively closes the neck opening thereof.

As the closure 134 is screwed downwardly onto the neck 126, the pawl 147 will begin to engage the recesses 130, and act as a ratchet holding means to prevent the closure 134 from being rotated in the reverse direction. The pawl 147 will move from one of the recesses 130 to the next as the closure 134 is tightened near the end of its downward travel on the neck 126, the vertical portion of the tab 145 becoming bowed without the breaking of the frangible webs 142 and 143, defined by the grooves, and which connect the upper end of the tab 145 to the outer skirt 148 in the vicinity of the upper surface of the peripheral portion of the top surface of the closure 134. It is to be noted that the pawl 147 is provided with a bevelled side (like the bevelled side 50, FIG. 1), which slides over the sloping sides of the recesses 130, whenever the closure 134 is being tightened on the neck 126. When the motion of the closure 134 is reversed on the neck 126 of the container 125, a straight side of the pawl 147 (like the straight side 52, FIG. 1) will engage the straight side of one of the recesses 130 and prevent the rotation of the closure 134 and its removal from the container neck 126, so long as the frangible webs 142 and 143 of the closure have not been broken. Thus, one can determine by visual inspection if the closure 134 has been removed by observing the condition of the frangible webs 142 and 143 and the top portion of the tab 145.

To remove the closure 134, from the container 125, the outer, lower end of the tab 145 is raised by application of a radially inwardly directed force to the tab, as diagramatically indicated by an arrowheaded line 149 in FIG. 13, to a point where the webs 142 and 143 become fractured and the pawl 147 becomes disengaged from that one of the recesses 130 on the vertical surface 128 in which it rested, allowing the closure 134 to be rotated in the opposite direction to remove the closure from the container neck.

The closure 134 shown in FIGS. 11–13 has the appearance of the first-described closure 22 illustrated in FIGS. 5 and 6, when oriented as shown therein and viewed from the outside. It is to be understood that the closure 134 of FIGS. 11–13 can be modified so that it would appear, again as viewed from the outside, like the closures 56 and 58, as illustrated respectively in FIGS. 6 and 7. In these cases, the pawl 147 and web 146 would be constructed as shown in FIGS. 12 and 13.

Figure 14:
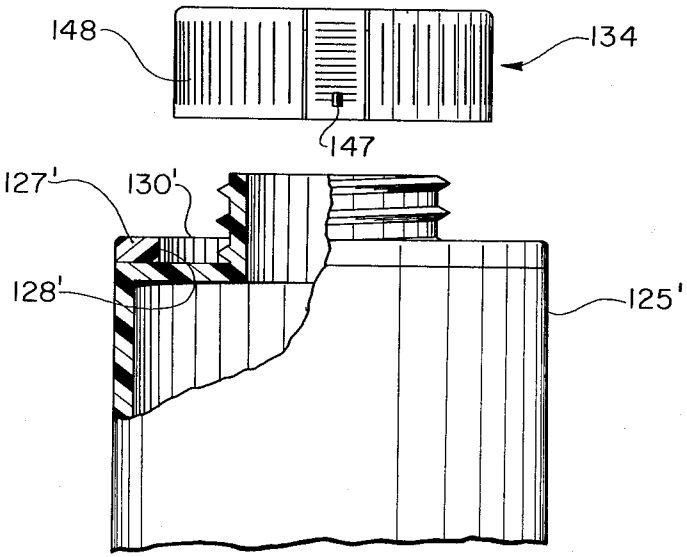
FIG. 14 is an exploded view in elevation of a container, shown fragmentally in accordance with a variant of the species shown in FIGS. 11–13.

A variant of the container 125 (FIGS. 11–13) is shown in FIG. 14, wherein in place of the step 127 (FIGS. 11–13) in the finish of the container 125 (FIGS. 11–13), a flat ring 127' is provided, the ring being fixed to the finish of a container 125' by a suitable glue, epoxy resin or the like. In this case, the ratchet teeth are defined by shaped recesses 130' provided about the inwardly facing surface 128' of the ring. The closure 134 (FIGS. 11–14) which is to be used with the container 125' may be constructed identically to the closure 134, as shown in FIGS. 11–13. The pawl 147 (FIGS. 11–13) cooperates with the recesses 130' as with the recesses 130 (FIGS. 11–13).

The present invention in its generic and specific aspects, not only achieves the aforementioned objects and obtains other aims, but also provides a combined closure and container which is strong, robust and can be readily shipped and transported without fracturing the frangible webs.

It is to be understood that the foregoing description and accompanying figures of drawing relate to preferred embodiments set out by way of examples, not by way of limitation. It is to be appreciated that numerous other embodiments and many variants are possible without departing from the spirit and scope of the invention, its scope being defined in the appended claims.

What is claimed is:

1. A container and safety closure therefor, including in combination:

a hollow container having external thread on a portion thereof and having an opening extending into the hollow container, an area of the container having a plurality of recesses extending inwardly from the outer surface of the container;

a closure provided with an internal thread adapted to screw on to and off the external thread on said portion of the container, said closure having a first web extending from a lower portion of the closure from one side thereof, a pawl extending from a surface of the first web to engage the recesses in the container when the closure is threadably moved downwardly and an upstanding tab extending upwardly from distal end of said first web; and at least one tamper-evident indicating, frangible web connecting the upstanding tab to said closure, said at least one tamper-evident web being fracturable by application of radially, inwardly directed force to the tab to fracture said at least one frangible web without fracturing the first web and disengage the pawl from the recesses so that the closure may be removed from the container.

2. The container and safety closure therefor according to claim 1, wherein said first web is integral with a lower portion of the closure and said pawl is integral with said first web.

3. The container and safety closure therefor according to claim 1, wherein the safety closure has a top and includes a cylindrical portion which carries said internal thread, the closure including an outer skirt, said first web extending to said outer skirt and said outer skirt depending from said top of said closure; and wherein said tab is separated from said outer skirt by a pair of longitudinal slots.

4. The container and safety closure according to claim 3, wherein said top of said closure is provided with a void positioned inwardly and between said pair of slots.

5. The container and safety closure according to claim 3, wherein said tab is connected to said top of said closure, and wherein said at least one frangible web is defined by a line of weakening provided between said tab and said top of said closure.

6. The container and safety closure according to claim 3, wherein said tab is separated from said top of said closure by a further slot.

7. The container and safety closure according to claim 3, wherein said at least one tamper-evident indicating frangible web comprises a pair of frangible webs connecting opposite sides of the upstanding tab to said closure in vicinity of respective upper ends of said slots.

8. The container and safety closure according to claim 3, wherein said closure includes an outer skirt, and wherein said at least one tamper-evident indicating frangible web comprises a pair of frangible webs connecting opposite sides of said upstanding tab to said outer skirt in vicinity of respective upper ends of said slots.

9. The container and safety closure according to claim 8, wherein said pair of frangible webs are defined by respective lines of weakening provided between said tab and said outer skirt of said closure.

10. The container and safety closure according to claim 1, wherein said closure includes a top, a void being provided in said top in substantial radial alignment with said tab.

11. The container and safety closure according to claim 1, wherein said closure includes a top, and wherein said tab is connected to said top of said closure, and wherein said at least one frangible web is defined by a line of weakening provided between said tab and said top of said closure.

12. The container and safety closure according to claim 1, wherein said closure includes a top and wherein said tab is separated from said top by a slot.

13. The container and safety closure according to claim 1, wherein said at least one tamper-evident indicating, frangible web comprises a pair of frangible webs connecting opposite sides of said upstanding tab to said closure in vicinity of its top.

14. The container and safety disclosure according to claim 1, wherein said tab is connected to said top of said closure, and wherein said at least one frangible web is defined by a line of weakening provided between said tab and said top of said closure.

15. The container and safety closure therefor according to claim 1, wherein said closure includes an outer skirt and wherein said at least one tamper-evident, indicating frangible web comprises a pair of frangible webs connecting opposite sides of said upstanding tab to said outer skirt in vicinity of respective upper ends of said slots.

16. The container and safety closure according to claim 15, wherein said pair of frangible webs are defined by respective lines of weakening provided between said tab and said outer skirt of said closure.

17. The container and safety closure according to claim 1, wherein said hollow container includes a tubular neck, said external thread is on said neck, and said plurality of recesses are in an area adjacent to and extending outwardly from the neck, substantially equal distant from the neck; and wherein said internal thread is adapted to be threaded on to and off the external thread on said neck, said first web extends from a lower portion of the closure outwardly from one side thereof and said pawl extends from an under surface of the first web.

18. The container and safety closure according to claim 1, wherein said hollow container includes a tubular portion, said external thread is on said tubular portion and said plurality of recesses are in an area of said tubular portion in vicinity of said external thread; and wherein said internal thread is adapted to be threaded on to and off the external thread, said first web extending from a lower portion of the closure downwardly and thence radially outwardly and wherein said pawl extends radially inwardly from a surface of the first web.

19. The container and safety closure according to claim 18, wherein said tubular portion is constituted by a neck, said external thread is on said neck and said plurality of recesses are in a substantially vertical surface of said neck.

20. A safety closure comprising an internally threaded cap provided with an internal thread adapted to screw on to and off an externally threaded portion of a container, said cap having a first web extending therefrom for engagement with recesses on a surface of a container, a pawl extending from a surface of the first web to engage recesses in a container when the closure is threadably moved downwardly thereon and an upstanding tab extending upwardly from distal end of said first web; and at least one tamper-evident indicating, frangible web connecting the upstanding tab to said cap, said at least one tamper-evident web being fracturable by application of radially, inwardly directed force to the tab to fracture said at least one frangible web without fracturing the first web and move the pawl from the recesses so that the closure may be removed from a container.

21. The safety closure according to claim 20, wherein said first web is integral with a lower portion of the cap and said pawl is integral with said first web.

22. The safety closure therefor according to claim 20, wherein the cap has a top and includes a cylindrical portion which carries said internal thread; and including an outer skirt, said first web of the cap extending to said outer skirt and said outer skirt depending from said top of said cap; and wherein said tab is separated from said outer skirt by a pair of longitudinal slots.

23. The safety closure according to claim 22, wherein said top of said cap is provided with a void positioned inwardly and between said pair of slots.

24. The safety closure according to claim 22, wherein said tab is connected to said top of said cap, and wherein said at least one frangible web is defined by a line of weakening between said tab and said top of said cap.

25. The safety closure according to claim 22, wherein said tab is separated from said top of said cap by a further slot.

26. The safety closure according to claim 22, wherein said at least one tamper-evident indicating frangible web comprises a pair of frangible webs connecting opposite sides of the upstanding tab to said cap in vicinity of respective upper ends of said slots.

27. The safety closure according to claim 22, wherein said cap includes an outer skirt, and wherein said at least one tamper-evident indicating frangible web comprises a pair of frangible webs connecting opposite sides of said upstanding tab to said outer skirt in vicinity of respective upper ends of said slots.

28. The safety closure according to claim 27, wherein said pair of frangible webs are defined by respective lines of weakening provided between said tab and said outer skirt of said cap.

29. The safety closure according to claim 20, wherein said cap includes a top, a void being provided in said top in substantial radial alignment with said tab.

30. The safety closure according to claim 20, wherein said cap includes a top, and wherein said tab is connected to said top of said cap, a line of weakening being provided between said tab and said top of said cap.

31. The safety closure according to claim 20, wherein said cap includes a top and wherein said tab is separated from said top by a slot.

32. The container and safety closure according to claim 20, wherein said at least one tamper-evident indicating, frangible web comprises a pair of frangible webs connecting opposite sides of said upstanding tab to said cap in vicinity of respective upper ends of said slots.

33. The safety closure therefor according to claim 20, wherein said cap includes an outer skirt and wherein said at least one tamper-evident, indicating frangible web comprises a pair of frangible webs connecting opposite sides of said upstanding tab to said outer skirt in vicinity of its top.

34. A container and safety closure therefor, including in combination:

a container having an externally threaded portion and having an opening extending into the container, an area of the container extending from the threaded portion and including an outer surface of the container in vicinity of the threaded portion having a plurality of recesses inwardly from the outer surface of the container;

a closure provided with an internal thread adapted to screw on to and off the externally threaded portion of the container, said closure having a first web extending therefrom adjacent to the the threaded portion and overlying the recesses and out of engagement therewith, a pawl extending from the first web to engage the recesses in the container when the closure is threadably moved downwardly and an upstanding tab extending upwardly from said first web; and at least one tamper-evident indicating, frangible web connecting the upstanding tab to said closure, said at least one tamper-evident web being fracturable by application of radially, inwardly directed force to the tab to fracture said at least one frangible web without fracturing the first web and disengage the pawl from the recesses so that the closure may be removed from the container.

35. The container and safety closure therefor according to claim 34, wherein said at least one frangible web is defined by at least one line of weakening between said tab and a peripheral portion of said closure.

36. The container and safety closure according to claim 34, wherein said at least one frangible web comprises a pair of frangible webs.

37. The container and safety closure according to claim 36, wherein said pair of frangible webs are defined by respective lines of weakening between said tab and a peripheral portion of said closure.

38. A safety closure comprising an internally threaded cap provided with an internal thread, said cap having a first web extending outwardly thereof, a pawl extending from a surface of the first web and an upstanding tab extending upwardly from said first web; and at least one tamper-evident indicating, frangible web connecting the upstanding tab to said cap, said at least one tamper-evident web being fracturable by application of radially, inwardly directed force to the tab to fracture said at least one frangible web without fracturing the first web, whereby the pawl may be removed from recesses in a surface of a container and the closure removed from and replaced on same.

39. The safety closure according to claim 38, wherein said at least one frangible web is defined by at least one line of weakening between said tab and a peripheral portion of said closure.

40. The safety closure according to claim 38, wherein said at least one frangible web comprises a pair of frangible webs.

41. The safety closure according to claim 40, wherein said pair of frangible webs are defined by respective lines of weakening between said tab and a peripheral portion of said closure.

42. The safety closure according to claim 38, wherein said pawl extends from an under surface of said first web.

43. The safety closure according to claim 38, wherein said pawl extended radially inwardly from the first web.

44. A container and safety closure therefor, including in combination:

a container having an externally threaded portion and having an opening extending into the container, an area of the container spaced from the threaded portion including a step defining a surface substantially vertical spaced from the threaded portion having a plurality of recesses inwardly from the substantially vertical surface;

a closure provided with an internal thread adapted to screw on to and off the externally threaded portion of the container, said closure having a first web extending therefrom adjacent to the threaded portion, an upstanding tab extending upwardly from said first web, a pawl extending radially outward from the tab to engage the recesses in the substantially vertical surface when the closure is threadably moved downwardly; and at least one tamper-evident indicating, frangible web connecting the upstanding tab to said closure, said at least one tamper-evident web being fracturable by application of radially, inwardly directed force to the tab to fracture said at least one frangible web without fracturing the first web and disengage the pawl from the recesses so that the closure may be removed from the container.

45. A safety closure comprising an internally threaded cap provided with an internal thread, said cap having a first web extending outwardly thereof, an upstanding tab extending upwardly from said first web, a pawl extending radially outward from a surface of said upstanding tab, and at least one tamper-evident indicating, frangible web connecting the upstanding tab to said cap, said at least one tamper-evident web being fracturable by application of radially, inwardly directed force to the tab to fracture said at least one frangible web without fracturing the first web, whereby the pawl may be removed from recesses in a surface of a container and the closure removed from and replaced on same.

* * * * *